United States Patent [19]

Diamond

[11] Patent Number: 4,542,853

[45] Date of Patent: Sep. 24, 1985

[54] FLUID VALVE WITH DIRECTIONAL OUTLET JET OF CONTINUOUSLY CHANGING DIRECTION

[76] Inventor: Harvey E. Diamond, 12952 Woodridge St., Studio City, Calif. 91604

[21] Appl. No.: 572,702

[22] Filed: Jan. 20, 1984

Related U.S. Application Data

[63] Continuation-in-part of Ser. No. 457,961, Jan. 14, 1983, abandoned, which is a continuation-in-part of Ser. No. 218,487, Dec. 22, 1980, abandoned.

[51] Int. Cl.[4] ..... B05B 3/16; B05B 7/00

[52] U.S. Cl. ..... 239/383; 239/428.5; 239/DIG. 16

[58] Field of Search ..... 239/380–383, 239/428.5, DIG. 16, 206; 4/492, 542, 569

[56] References Cited

U.S. PATENT DOCUMENTS 2,778,620 1/1957 Goodrie ..... 239/428.5

2,974,877 3/1961 Hruby, Jr. ..... 239/DIG. 16 X

FOREIGN PATENT DOCUMENTS 43095 4/1960 Poland ..... 239/428.5

*Primary Examiner*—Andres Kashnikow

*Attorney, Agent, or Firm*—I. Morley Drucker

[57] ABSTRACT

A fluid-flow valve or nozzle discharging a stream of continuously changing direction, particularly for use as a shower head or for use in hydrotherapy to discharge a fluid stream or a turbulent jet of an intimate water-air admixture, respectively, the preferably adjustable discharge pattern covering a conical or annular surface of revolution, or variations thereof. The valve or nozzle comprises a body, a moveable rotor chamber coaxially mounted within the valve body, and a rotor body within the rotor chamber. Water and air are fed to inlets and to pass through the bore of the moving rotor body, and discharged through a flared mouth where a control knob can be rotated to influence the fluid flows and the motion of the rotor body.

50 Claims, 24 Drawing Figures

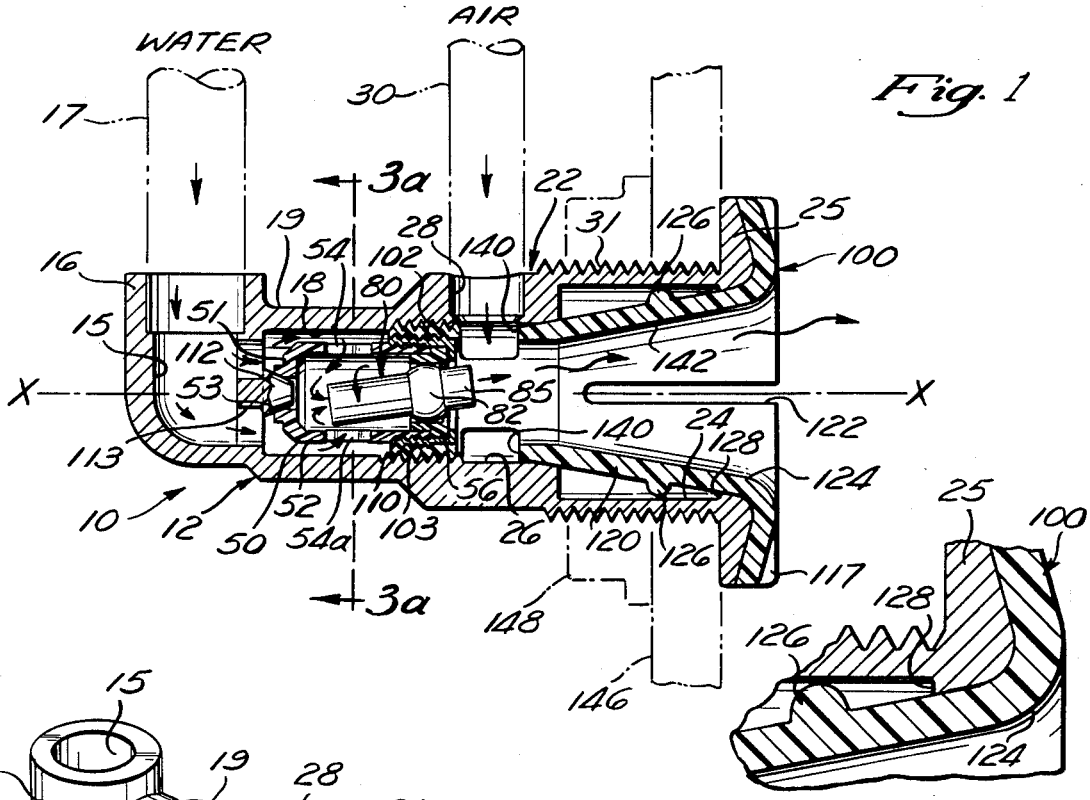
Fig. 1
Fig. 1a
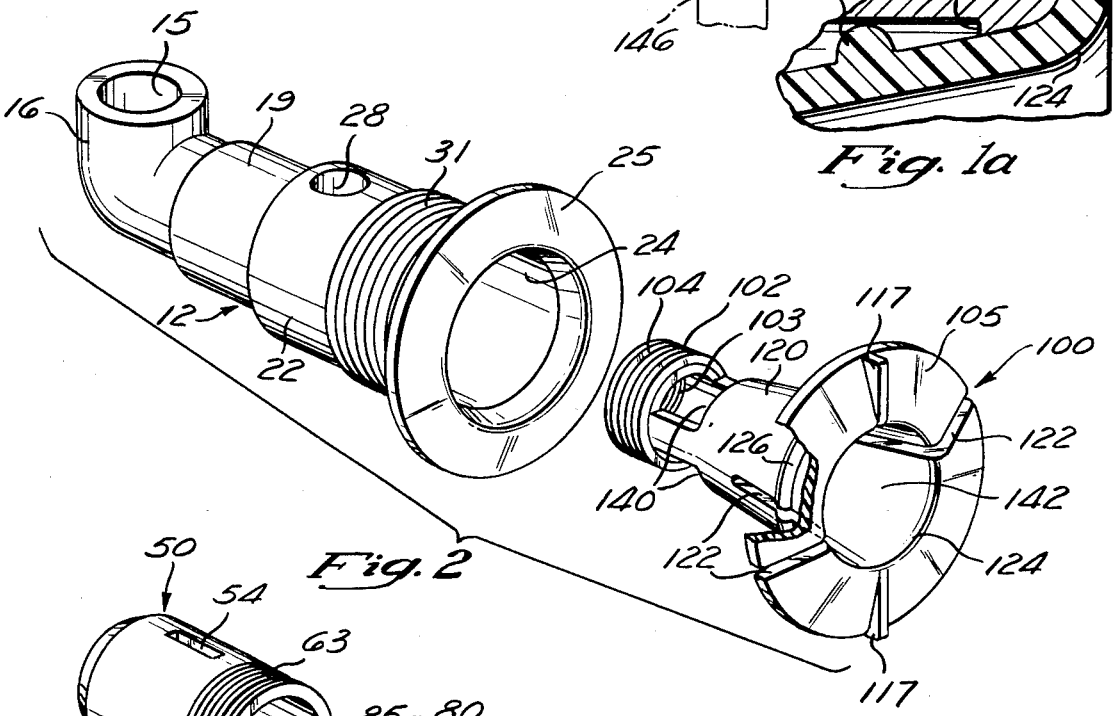
Fig. 2
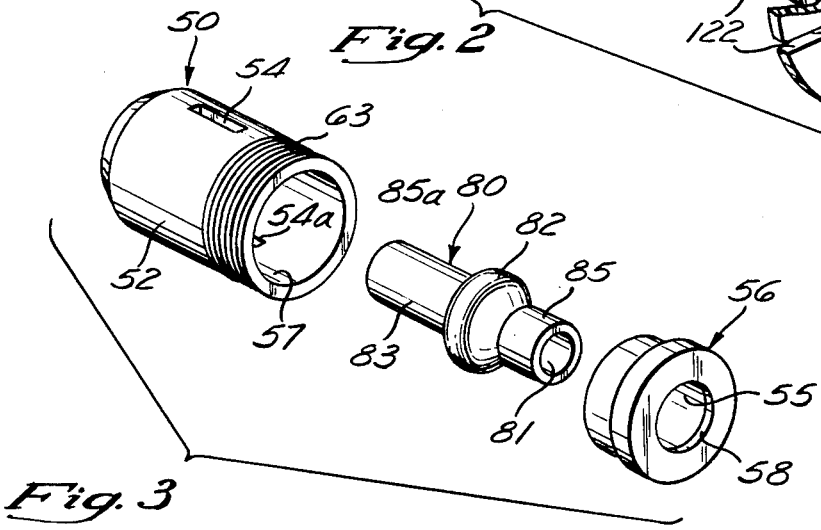
Fig. 3
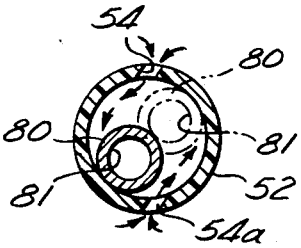
Fig. 3a

Fig. 4
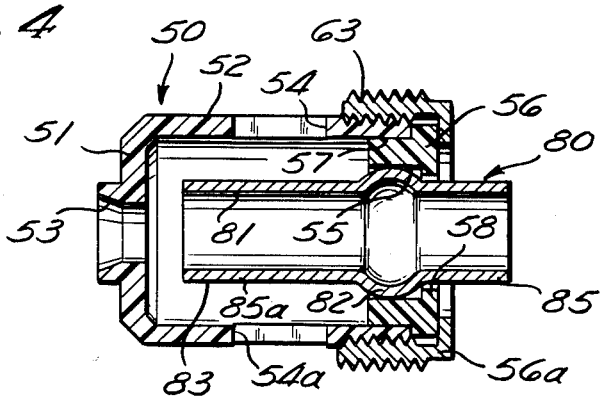
Fig. 5
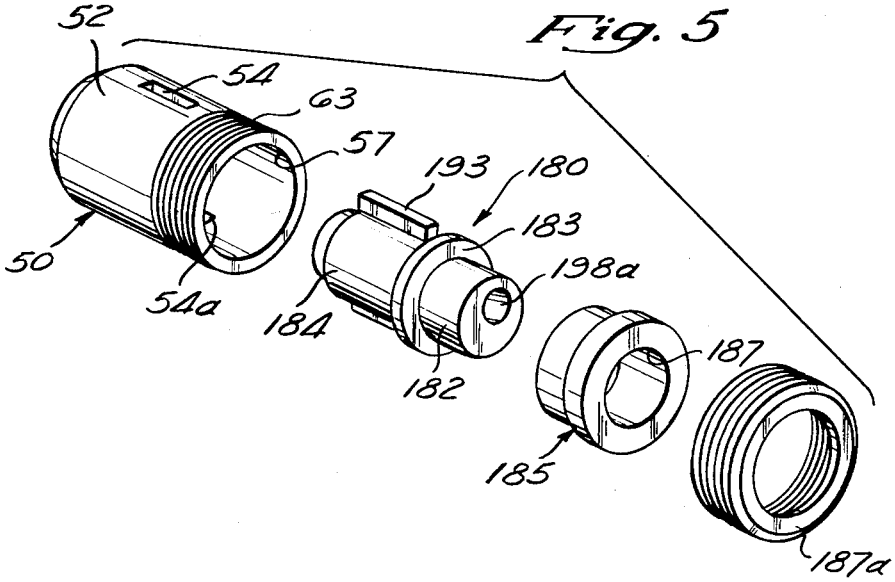
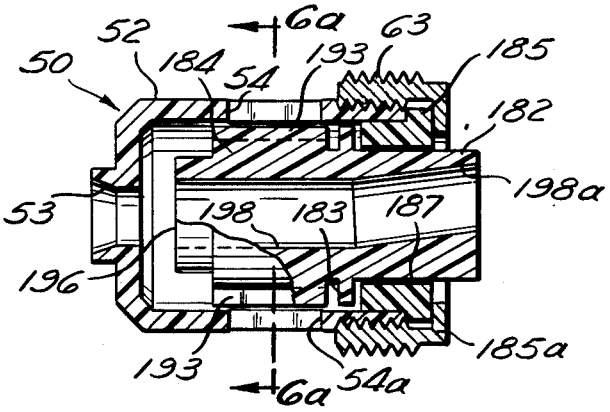
Fig. 6
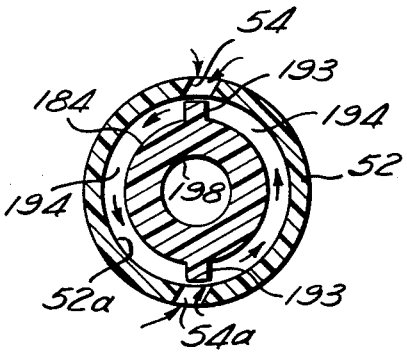
Fig. 6a

Fig. 9
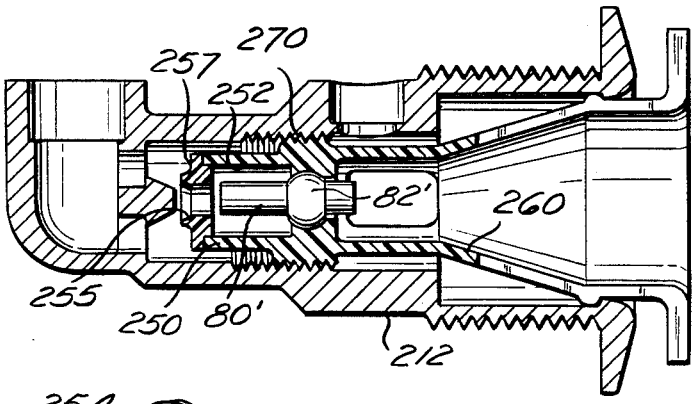
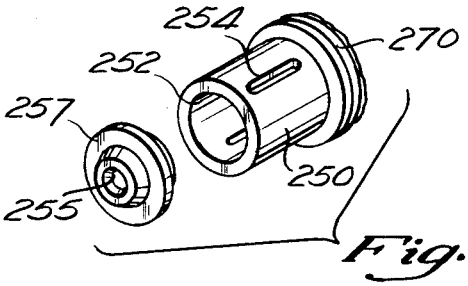
Fig. 10
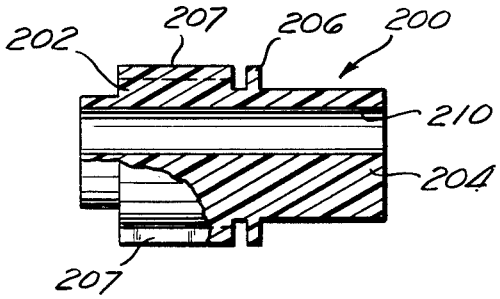
Fig. 7
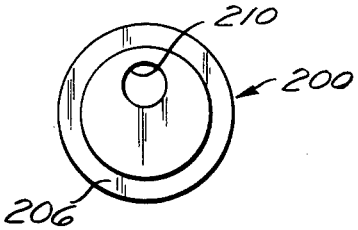
Fig. 8

AIR
WATER
400
412
416
418
450
480
481
481a
481b
482
483
485
487
489
490
492
493
494
496
498
499
500
502
504
W
W1
14
15

600
612
616
618
680
681
682
685
686
687
690
692
693
694
696
696a
698
700
702
704
710
720
650
W2
W
A
A'
AIR
WATER
20
21

FLUID VALVE WITH DIRECTIONAL OUTLET JET OF CONTINUOUSLY CHANGING DIRECTION

CROSS-REFERENCE TO RELATED APPLICATIONS

This application is a continuation-in-part of application Ser. No. 457,961, filed Jan. 14, 1983 entitled "IMPROVEMENTS IN A FLUID VALVE WITH DIRECTIONAL OUTLET JET", which said application being, in turn, a continuation-in-part of application Ser. No. 218,487, filed Dec. 22, 1980 and entitled "A FLUID VALVE WITH DIRECTIONAL OUTLET JET OF CONTINUOUSLY CHANGING DIRECTION", both now abandoned.

BACKGROUND OF THE INVENTION

This invention lies in the field of fluid valves and discharge nozzles and more particularly pertains to fluid discharge nozzles wherein a particular discharge pattern, having an automatic continuously changing direction, is desired. The fluid discharge nozzles have particular application in hydrotherapy and are adapted to discharge a turbulent air-water admixture for this purpose.

Fluid valves and discharge nozzles of the prior art include units having manually directionally adjustable outlets such as is disclosed in applicant's U.S. Pat. No. 4,221,336 entitled "NOZZLE WITH DIRECTIONALLY VARIABLE OUTLET" issued on Sept. 9, 1980.

The applicant wishes to make of record the following prior art:

| PATENTEE | PATENT NO. |
|---|---|
| Walter C. Lorenzen | 3,677,474 |
| Alfred M. Moen | 3,997,116 |
| Wayne D. Steimle | 3,985,303 |
| J. H. McElroy | 1,056,811 |

Each of the foregoing patents shows directionally adjustable outlets for water, or water-air admixtures. However, each of the outlet nozzles are manually adjustable. The outlet nozzles of the present invention teach the formation of an outlet jet of fluid of automatically continuously changing direction, the direction changing in accordance with a predetermined flow pattern, e.g., annular or conical.

The following prior art should also be noted:

| PATENTEE | PATENT NO. |
|---|---|
| Larry P. Meyer | 4,073,438 |
| John H. Drew et al. | 3,791,584 |
| Mark Healy | 3,627,205 |
| Gerald Tokar | 3,608,828 |
| J. O. Hruby, Jr. | 2,974,877 |
| British | 2,046,129 |
| British | 1,250,363 |
| British | 1,119,192 |
| J. O. Hruby, Jr. | 2,639,191 |
| M. C. Aubert | 3,091,400 |
| J. O. Hruby, Jr. | 3,357,643 |
| German | 719,424 |

The Meyer and Drew patents are the closest prior art presently known to the applicant. These patents relate to a sprinkler or shower head having means for automatically orbiting (or gyrating) and rotating a discharge nozzle, under the influence of water pressure. The structure of the Meyer and Drew patents are such as to impart to the discharge nozzle both an oscillating (or gyrating) movement and a rotational movement and would not appear to be suitable in a whirlpool bath environment. The structure of the applicant's invention provides a different and a more readily adjustable, pattern of water discharge than Meyer or Drew, and one that is much more suitable for hydrotherapy than Meyer or Drew.

It is a major object of the novel valve disclosed herein to produce a discharge jet of water and air which continuously generates a conical or annular surface of revolution or variations thereof in a simple and reproducible manner, and which discharge pattern may be readily varied. It is a further object to produce any of the foregoing discharge patterns, with water alone, or an intimate admixture of air and water, or other fluids.

The fluid valve of this invention is therefore capable of continuous therapeutic massaging action over a much wider range of action than the directionally static jets of the prior art, or other discharge nozzles of the prior art.

SUMMARY OF THE INVENTION

This invention is directed towards a fluid valve or nozzle for discharging a directional outlet fluid jet of continuously changing direction, automatically, and in a repetitive, reproducible pattern. The fluid valve pertains, in particular, to fluid discharge nozzles for use in hydrotherapy, wherein air is intimately admixed with the effluent liquid (water) stream, to create a turbulent air-water directional outlet stream of continuously changing direction, although the fluid valve may also be used as a shower head, i.e., outside of a whirlpool bath environment The valve of this invention comprises a main valve body having a first fluid inlet means, a first fluid outlet means, and a preferably, generally cylindrical valve bore interposed between, and in communication with, the first fluid inlet and outlet means. Mounted, in as frictionless a manner as possible, within the said main valve body, is a cylindrical housing or hollow rotor chamber. The cylindrical rotor chamber is provided with a centrally apertured end wall on the inlet or upstream side of the valve. This rotor chamber is of smaller diameter than the valve bore diameter and is mounted coaxially therewith whereby the cylindrical wall of the chamber is spaced from the valve bore inner wall surface. The cylindrical wall of the rotor chamber contains one or more radially outer apertures which function as radially offset fluid inlet port means. The rotor chamber is preferably movable along the longitudinal axis of the valve bore to a number of multiple, different, positions. In one embodiment, in one extreme of such multiple positions, the central aperture of the end wall of the rotor chamber, on the inlet or upstream side, is closed by a plug, centrally mounted in the inlet side of the valve bore and in the opposed extreme position, the central inlet aperture in the rotor chamber end wall is completely open. Intermediate positions, between these extremes, cause various degrees of closure of the central inlet aperture of the rotor chamber. In this way, fluid in a fluid stream entering the valve bore from the first fluid inlet means is divided, in its travel, between the central inlet aperture of the rotor chamber, and the radially offset inlet ports of the rotor chamber, in a predetermined, readily adjustable, manner. In another presently preferred embodiment, various degrees of closure of the radially offset inlet ports to the rotor chamber is provided, by movement of the rotor chamber without closing off the central, or main, water inlet to the rotor chamber.

An elongated tubular, rotor body is mounted within rotor chamber, the rotor body having a rotor bore extending therethrough. The rotor body is mounted, within the rotor chamber, for either rotational motion or rotational rocking movement, about the longitudinal axis of the valve bore, the type of mounting depending upon the location of the rotor bore within the rotor body.

In operation, the rotor chamber is positioned within, and along the longitudinal axis of the valve bore in a predetermined manner, by means of either an internally or externally operable control knob. Fluid flow is initiated, and the fluid is divided between the central inlet aperture of the rotor chamber and the radially offset inlet ports of the rotor chamber in a preset proportion depending upon the axial setting of the rotor chamber. The fluid passing through the radially offset fluid inlet ports of the rotor chamber exerts force on the rotor body wall exterior and initiates both rotatory and up-down (rocking) movement of the rotor body, or purely rotational movement, depending upon the type of mounting provided for the rotor body. Thus, if the rotor bore is coaxially positioned within the rotor body, the rotor body is mounted for both rocking and rotational movement. Fluid pressure exerted, tangentially, on the exterior wall of the rotor body by means of fluid flow from the radially offset inlet ports, will then cause continuous rocking and rotational motion of the rotor body and initiates continuous, repetitive, angular displacement of the rotor bore with respect to the longitudinal axis of the valve bore. The effluent fluid will exit in the form of a directional jet of continuously changing direction extending between fixed preset limits dictated by the extent of the rocking movement of the rotor body.

When the rotor body is mounted, for pure rotary movement, within the rotor chamber, the radially outer fluid inlet ports in said rotary chamber are positioned so as to direct the inlet fluid sream, tangentially, onto the rotor body wall surface, in a continuous manner, and cause rotation thereof. In this case, the rotor bore will be either wholly or partially eccentric with respect to the longitudinal axis of the valve bore, or will be parallel but radially offset with respect to said longitudinal axis. The flow of fluid, resulting from flow through the continously rotating eccentric rotor bore is a directional fluid jet of continuously changing direction extending over a conical surface of revolution while the directional fluid jet exiting from the continuously rotating radially offset but parallel bore, takes the form of an annular stream of water.

The velocity of the exiting directional streams or jets of fluid is readily adjustable by increasing or decreasing the fluid flow through the radial outer inlet ports. Adjustment may be made by externally operable control members or by otherwise internally adjusting the rotor chamber position. The effluent fluid stream may be further admixed, with air, to form an intimate, turbulent, air-water admixture for use in hydrotherapy "whirlpool" baths, or may be used as an effluent for shower heads and the like.

In the presently preferred embodiment, the rotor body is mounted, by wholly concealed ball-bearings, within the valve bore to provide as frictionless and contamination-free a mounting as possible thereby leading to an efficient, reliable and reproducible automically and continuously changing discharge pattern, even at very low levels of inlet water pressure, and which discharge pattern may be readily varied by simple, externally located or internal, control means.

The fluid valve of this invention is simple to manufacture and reliable in operation. It requires only a small number of parts, i.e., the valve body, the longitudinally adjustable cylindrical rotor chamber mounted therewithin, and the tubular rotor body mounted for movement, either rotary or rocking, within the rotor chamber.

BRIEF DESCRIPTION OF THE DRAWINGS

FIG. 1 is a longitudinal cross section of a first embodiment of my fluid valve, the fluid and air inlet conduits and valve mounting shown in phanton;

FIG. 1*a* is a enlarged detail of FIG. 1 showing within the arcuate arrow 1*a* the detent means of the adjusting member at the valve bore outlet;

FIG. 2 is an exploded perspective view of the valve body and adjusting member of FIG. 1;

FIG. 3 is an exploded perspective view of the rotor body and chamber therefor of FIG. 1;

FIG. 3*a* is a cross section taken along line 3*a*—3*a* of FIG. 1.

FIG. 4 is a longitudinal cross section of the rotor chamber and rotor body only, of FIG. 1, showing the first radially outer inlet ports and second centrally positioned inlet port means;

FIG. 5 is an exploded perspective view of a second embodiment of rotor body and chamber therefor;

FIG. 6 is a longitudinal cross section of the assembled rotor body and chamber of FIG. 5.

FIG. 6*a* is a transverse cross section taken along the line 6*a*—6*a* of FIG. 6.

FIG. 7 is a longitudinal cross section of a third embodiment of rotor body;

FIG. 8 is an end elevational view of FIG. 7.

FIG. 9 is a longitudinal cross section of a fourth embodiment of my invention;

FIG. 10 is a fragmentary view, in perspective, showing a cap detail of the rotor chamber;

DETAILED DESCRIPTION OF THE INVENTION

Figure 11:
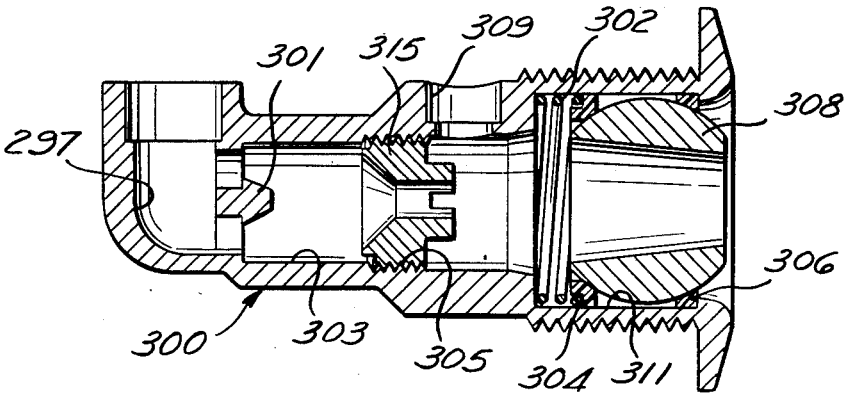
FIG. 11 is a longitudinal cross section of a directionally static, manually adustable valve utilizing the same valve body as shown in FIG. 1.

The fluid valve of this invention, as shown in FIGS. 1–4, is designated generally by the numeral 10 and comprises, generally, an elongated valve body 12, a rotor chamber 50 coaxially mounted within the valve body 12, and a rotor body 80 mounted within the rotor chamber 50.

The valve body 12 is provided with a first fluid inlet means 16 having a transversely aligned fluid bore 15 adapted to be sealingly connected to a fluid (water) inlet pipe denoted in phantom line 17. The fluid bore 15 of first fluid inlet means 16 opens into a generally cylindrical intermediate valve body section 19 defining an elongated cylindrical valve bore 18 having a longitudinal axis X—X. The valve body 12 is provided with a fluid outlet means 22 having a relatively enlarged bore 24 adjacent the mouth or exit end 25 thereof, the bore 24 stepping down to a smaller diameter bore 26 which bore 26 is located immediately downstream of intermediate valve body section 19. The fluid outlet means 22 is provided with generally transversely extending air inlet means, bore 28, opening into bore 26 of the fluid outlet means 22, which bore 28 enables air admixture with the effluent water stream to take place as will be explained hereafter in detail. The air inlet tube connection to bore 28 is shown in phantom line 30.

Mounted for longitudinal movement, along the longitudinal axis X—X of valve bore 18, is the rotor chamber. The manner of its longitudinal axial movement will be described shortly hereafter.

Referring now to FIGS. 1, 3, 3*a* and 4, in particular, the rotor housing or chamber 50 is generally cylindrical in shape and is provided with an end wall 51 at the inlet or upstream side of chamber 50. As best shown in FIG. 4, the inlet end wall 51 of chamber 50 is provided with a flared central aperture or valve seat 53 and the cylindrical wall 52 of rotor chamber 50 is provided with radially outer fluid inlet ports 54, 54*a*.

The rotor body member 80 is contained, for rocking and rotational movement, within the rotor chamber 50 in the following manner. The rotor body member 80, in the embodiment shown in FIGS. 1, 3, 3*a* and 4 is an elongated tubular member having a rotor bore 81 extending coaxially therethrough. The tubular wall 83 of rotor body 80 is enlarged near one end thereof forming a toroidally-shaped mounting means or member 82, projecting from the surface of the tubular rotor body wall 83 in an off-center relationship with respect to the length of the rotor body. The toroidally-shaped member 82 is seated for both limited up-down (rocking) movement and rotational movement within cylindrical bore 55 of cap member 56, the cap member, in turn, being press-fitted into the open upstream, end of the rotor chamber 50. As clearly shown in FIGS. 1 and 4, the downstream end 85 of rotor body 80 extends through cap member 56, the rotor body 80 being, however, retained (from axial downstream displacement) within cap member 56 by its radially inwardly extending annular shoulder 58. The cap member 56, in turn, is stably held within the downstream end of rotor chamber 50 by means such as a threaded retaining member 56*a* (see FIG. 4 especially).

The rotor chamber 50, together with the rotor body 80 assembled therein, as shown in FIG. 4 is then affixed or mounted to a generally frustro-conical adjustment, or control, knob or member 100 as follows. The control knob 100 is provided with a threaded connector end 102, the connector end having both an internally threaded surface 103 and an externally threaded surface 104 as best seen in FIGS. 1 and 2. The retaining member 56*a* of rotor chamber 50 has a portion of its external wall 52 thereof threaded, as designated by the numeral 63, the threaded surface 63 being threadably mounted to complementary threaded surface 103 of the control knob connector end 102. The control knob 100, and the rotor chamber 50 are now equivalent, in a functional sense, to a single, unitary, component. The flared control knob 100 and rotor chamber 50, affixed thereto, are now inserted into the valve body 12 and rotated until threaded surface 104 is completely threadably engaged to the internally threaded surface 110 of valve bore 18, as shown in FIG. 1. In this condition, as shown in FIG. 1, the centrally located inlet aperture, or valve set 53 of rotor chamber 50 is completely closed by a tapered valve plug 112 secured within, and along the axis of, the valve bore 18, by means of a transversely extending strut member 113. The strut 113 and plug 112 are preferably integrally formed with the valve body 12.

The control knob 100 has protruding wing portions 117 to enable easy gripping thereof and easy rotation, within valve body 12.

The flared body 120 of control knob 100 is provided with a plurality of longitudinally extending slots 122, as shown in FIGS. 1 and 2, the purpose of which are to enable manual compression of the mouth 124 of control knob 100 thereby enabling an annular enlargement or annular retaining bead 126, formed on the exterior of the control knob body 120, to move inwardly past an annular retaining shoulder 128 formed on valve body 12 just inwardly of the mouth 25. The annular retaining bead prevents accidental displacement, in an axial direction, of the control knob 100 relative to the valve body 12.

In the assembled condition, shown in FIG. 1, the control knob 100 is rotatable in a counter-clockwise direction to unseat the central valve seat aperture 53 from the valve plug 112 (this position not being shown). Thus, some fluid, entering the fluid inlet means 16 may (or may not) pass through central valve seat aperture 53 of rotor chamber 50.

It is also to be noted that the outer cylindrical wall 52 of the rotor chamber is spaced from the inner wall surface of the valve bore 18 whereby fluid not passing through central valve seat aperture 53 will pass through radially outer inlet ports 54, 54*a* of rotor chamber 50 and thence into the rotor chamber interior itself.

To further expand on the operation of the fluid valve of FIGS. 1–4, and analyzing the condition shown in FIG. 1, all of the water entering the fluid inlet bore 15 from pipe 17 will pass through radially outer or offset inlet ports 54, 54*a* (since valve seat 112 has closed off the central inlet valve seat aperture 53). The inlet ports 54, 54*a* are inclined so as to inject fluid onto the walls of the rotor body 80, with a substantial tangential component of force, relative to the rotor body wall, to thereby impart a high degree of rotation of the rotor body in either the counter-clockwise direction, as shown in FIG. 3*a*, by way of example, or in the clockwise direction.

As mentioned previously, the upstream side 85*a* of rotor body 80 is heavier than the downstream side 85 because the fulcrum provided, by toroidal seat 82 and the bore 55 of cap member 56, is off-center. The rotor body will thus initially assume an inclined non-axial attitude wherein the downstream side 85*a* is below the upstream side 85, as shown in FIG. 1. As the water pressure continues to be applied, one or the other of the fluid jets from tangential inlets 54 and 54*a* will displace the inlet side 85*a* of rotor body 80 away from its initial attitude and into the path of the other tangential inlet of the fluid jets. This displacement repeats itself back and forth between the tangential fluid jets causing the inlet side 85*a* of the rotor body 80 to toggle diametrically across the rotor chamber 50, such that the inlet side 85*a* is constantly being urged away from the longitudinal axis of the rotor chamber 50.

The net result is that inlet side 85*a* of rotor body 80 will tend to describe a generally conical surface of revolution with its apex at the fulcrum provided by toroidal surface 82. It is clear that the outlet side 85 of rotor body 80 describes a similar but opposit trajectory about toroidal fulcrum 82. Thus, as the rotor body 80 moves under the influence of angularly injected fluid the rotor bore 81 will be continuously angularly displaced with respect to the longitudinal axis of the cylindrical valve bore 12; and fluid entering the rotor chamber 50 then enters, and is projected by, the moving rotor bore 81 through the valve 10 as a directional jet of continuously changing direction. Various patterns of movement of the rotor body 80 may be obtained by changing the angle at which the tangential inlets 54 and 54*a* enter the rotor chamber 80.

As the valve seat aperture 53 of chamber 50 is opened to permit more flow centrally through the chamber interior, there is less fluid flow impinging on the wall of the rotor body 80 and consequently the velocity of the outlet stream and/or the conical surface of revolution generated by the directional jet will decrease.

Air is introduced, if desired, to the directional outlet fluid jets, exiting from the outlet side 85 of rotor bore 80. This is accomplished by aligning openings 140, formed at the throat control knob 100, with the air inlet means 28. Air entering the openings 140 at the throat of the venturi formed within the flared control knob member 100 will be intimately admixed with the onrushing, exiting, continuously changing directional fluid stream. The frustro-conical bore of the venturi of control member 100 is designated by the numeral 142.

The entire valve assembly 10, as shown in FIG. 1 is attached to an appropriate wall, such as a whirlpool bath wall 146 by inserting the valve 10, through an appropriately sized opening in the wall, and securing the valve 10 to the wall by means of threaded collar 148 shown in phantom, mounted to the externally threaded surface 31 of valve body 12.

The valve components are preferably made of either metal or plastic. The valve body 12 is preferably made of brass whereas the control knob 100, rotor chamber 50, rotor body 80, and cap member 56 are preferably made of low-friction tough plastic such as Lexan 141, manufactured by General Electric Company. It will be understood that other materials may be employed to fulfill the purposes of this invention.

In the FIGS. 1–4 embodiment, the rotor body 80 is mounted for both rotational and up-down rocking motion within rotor chamber 50. The same rotor chamber 50 is also employed with a modified form of rotor body 180, this rotor body 180 being mounted within rotor chamber 50 for substantially rotational motion only, under the influence of fluid entering the interior of rotor chamber 50 through fluid inlet ports 54, 54*a*, as best shown in FIGS. 5–6*a*.

In the modification shown in FIGS. 5–6*a* the rotor body 180 is generally cylindrical in nature and comprises an upstream portion 184 and a downstream portion 182 separated by a transversely extending annular collar 183. The downstream portion 182 of rotor body 180 extends through, and is rotatable within, longitudinally extending bore 187 of cap member 185. Collar 183 acts as a retaining member preventing axial displacement of rotor body 180 in the downstream direction.

Cap member 185, carrying the rotor body 180 in the manner aforedescribed, is then press-fitted into the open, downstream end 57 of rotor chamber 50, as shown in FIG. 6, and further stably retained by threaded retainer member 185*a*. The upstream portion 184 of rotor body 180 is thus wholly contained within rotor chamber 50 and is mounted therewithin for essentially rotational movement only about the longitudinal axis of the rotor chamber 50 and about the longitudinal axis X—X of valve bore 18 when rotor chamber 50 is mounted within valve bore 12 as shown in FIG. 1.

The exterior wall of upstream portion 184 of rotor body 180 is provided with a plurality of upstanding, longitudinally extending, flange members 193. As best shown in FIG. 6*a*, fluid entering inclined radially outer inlet ports 54, 54*a* enters the annular space 194 between the rotor body 180 and the interior wall 52*a* of rotor chamber 50, and thereby exerts pressure in a counterclockwise direction, on the flange members 193. Rotation of the rotor body 180 in the direction shown, is then initiated. The fluid then proceeds, from the annulus 194 to the upstream, or inlet end 196 of rotor bore 198 and downstream through the rotating rotor bore. The rotor bore is eccentric, at least at its downstream or outlet side; the eccentric bore (being designated by the numeral 198*a*) will, when rotor body 180 is rotated, describe a conical surface or revolution, and the fluid stream exiting therefrom, will follow an effluent path of continuously changing direction along a conical path of revolution.

Inasmuch as the rotor chamber 50 and cap member 185 is essentially of the same configuration as in FIG. 1, the means for dividing or adjusting fluid flow between central valve seat aperture 53 and radially outer ports 54, 54*a* and thereby regulating the velocity of the directional fluid jet emanating from rotor bore 198*a*, the means of external control and the means of air-water admixing are essentially the same as described with the FIG. 1.

Another embodiment of my invention is shown in FIGS. 7 and 8. In this embodiment, the rotor body 200 has, as in FIGS. 5–6*a*, an upstream portion 202 and a downstream portion 204 separated by a transversely extending collar member 206. The upstream portion 202 is provided with upstanding paddle members 207. The rotor body 200 is mounted for essentially pure rotational motion, in a manner described with reference to rotor body 180 of FIGS. 5–6*a*. The bore 210 of rotor body 200 however is not eccentric but is parallel to, but the radially offset from, the longitudinal axis X—X of valve bore 18. The effluent path of fluid flow from bore 210 traces a continuously changing directional stream forming an annular surface of revolution.

FIGS. 9 (and 10) depicts a further modified embodiment of my invention wherein the rotor chamber 250 and external control knob 260 components are cast or molded as an integral unit. FIG. 10 shows a perspective view of rotor chamber 250 and plug 257. The rotor body 80' is mounted, for rocking and rotational motion, within the rotor chamber 250, by means of toroidal plug 82, in a manner similar to that shown in FIGS. 1–4. The rotor chamber 250 then has its upstream end 252 closed off by centrally apertured plug 257 since the rotor body 80' must be first inserted, within the rotor chamber 250, through the upstream end 252.

The unitary rotor chamber 250 and control knob 260, together with the rotor body 80', is threadably mounted into valve body 212, the engaging threadable surfaces being indicated generally by the numerals 270, in FIGS. 9 and 10. In FIG. 9, the control knob 260 is shown in its most downstream position wherein the control aperture 255 of plug 257 is completely open—so that little, if any fluid flow will enter the rotor chamber 250 through radially outer ports 254. As the control knob 260 is rotated to a more upstream position, the control aperture 255 is closed off to a greater and greater degree. The manner of adjustment of fluid flow through the central inlet aperture 255 and the radially outer inlet ports (not shown), is essentially the same as that heretofore described within reference to FIGS. 1–4.

The valve body 300, as shown in FIG. 11, is essentially of the same configuration as that shown in FIG. 1, and is utilized as a valve body for the other types of valves as well, as will be shown.

The valve body 300 has a fluid inlet bore or means 297, a centrall located, integral valve plug 301 in the inlet or upstream side, a generally cylindrical valve bore 303 immediately downstream of plug 301, a transverse air inlet bore or means 309 communicating with the valve bore just downstream of the threaded surface area 305, and an enlarged valve bore 311 at the downstream end of the valve body 300. The valve body 300, as described, is designed to contain not only the components of the valve of the instant invention, but is designed so as to contain the internal components of a manually adjustable directional jet stream, of the type described in my U.S. Pat. No. 4,221,336. Thus, a spring member 302, inner and outer bearing members 304, 306 and manually rotatable discharge ball or nozzle 308 is contained within enlarged downstream valve bore 311, and a fluid flow restrictor 315 is threadably mounted to threaded surface 305 just upstream of the air inlet means 309 in order to create an intimate air-water admixture as the water exits from the restrictor 315 and enters the enlarged downstream bore section 311. The valve body configuration of this invention thus can be seen to have multiple uses.

Referring now to the embodiment of FIGS. 12–15, the fluid valve is designated generally by the numeral 400 and comprises, generally, an elongated valve body 412, a rotor chamber 450 coaxially mounted within the valve body 412 and a rotor body 480 mounted within the rotor chamber 450.

The rotor body 480 is provided with a rotor bore 481, a downstream portion of which, **481*a* is radially offset; the rotor body 480 is also provided with a plurality of external, generally radially projecting fins or paddle members 482 at its downstream end. Near the upstream end of the rotor body 480, a plurality of ball-bearings contained within races in a conventional manner, and designated generally by the numeral 485, is provided. The inlet to the rotor bore 481 (designated 481*b*), is enlarged and communicates directly with the main fluid stream entering the first fluid inlet means 416 of valve body 412**.

Figures 12, 13, 14, 15:
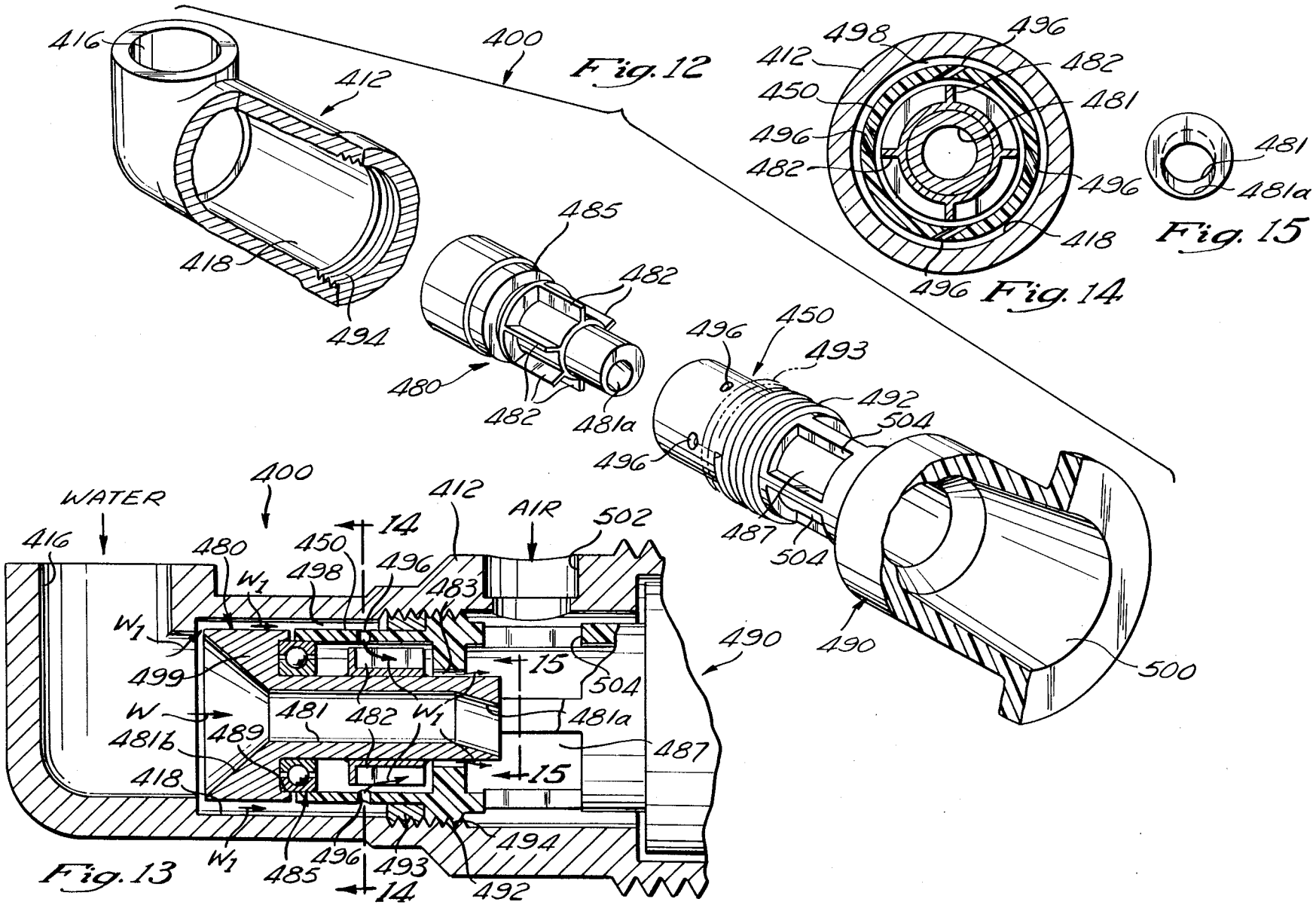
FIG. 12 is an exploded, perspective, partially sectional view of a fifth embodiment of my invention.
FIG. 13 is a partial, longitudinal cross-section of the assembled unit of FIG. 12.
FIG. 14 is a transverse cross-section taken along line 14—14 of FIG. 13.
FIG. 15 is an end view taken along line 15—15 of FIG. 13.
Figure 16:
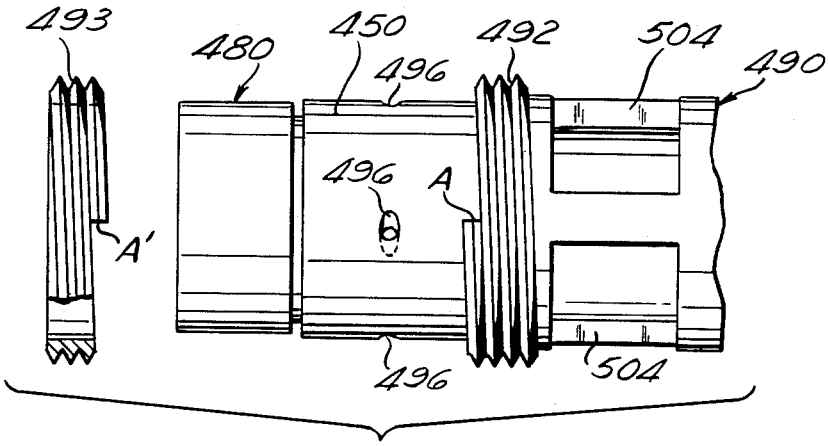
FIG. 16 shows in an exploded, side elevational fragmentary view, of several components of the fifth embodiment shown in FIGS. 12–15.
Figure 17:
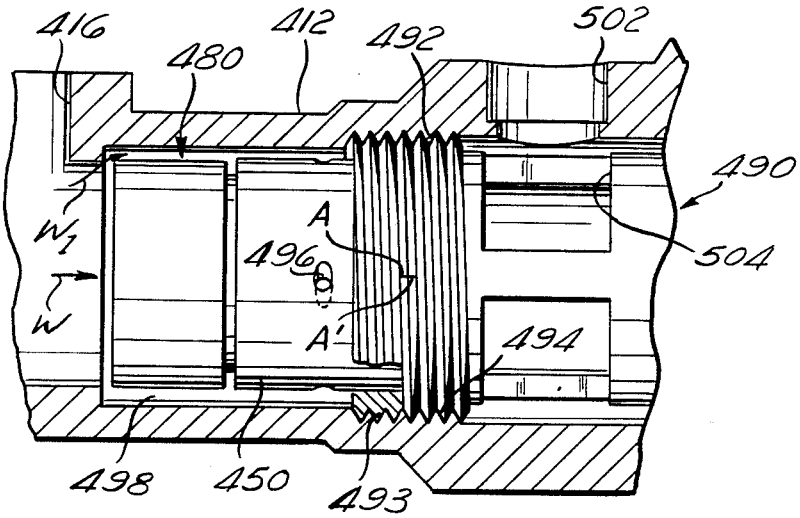
FIG. 17 is an assembled longitudinal cross-section of the components of FIG. 16.

The rotor chamber 450 is shown as being integrally affixed (e.g., molded or casted) to a control means or knob 490 as best shown in FIGS. 12 and 13. It will be understood however that the rotor chamber may be a separate component from that of the control means or knob 490 and may be threadably engaged or otherwise connected thereto through various forms of mechanical linkage. The control means 490 has an externally threaded intermediate section 492 provided therein for threadable engagement thereof within the valve bore 418, as will be seen. Moreover, as best shown in FIGS. 16 and 17 a separate, externally threaded shroud control ring 493 slideably interfits onto connector knob 490, immediately adjacent threaded section 492, the split threads A and A' of sections 492 and 493 abutting each other as best shown in FIGS. 16 and 17. The purpose of shroud control ring 493 will be explained hereafter.

To assemble the fluid valve components, the rotor body 480 is press-fitted onto the rotor chamber end of the control knob 490, as shown in FIG. 13, the press-fit occurring between the external surface of the ball-bearing means 485 and the upstream end of the internal wall of the rotor chamber 480. The control knob 490 and rotor body 480, assembled thereto, is then threadably mounted within the valve bore 418 of the valve body 412 by means of the engagement of external threaded sections 492 and externally threaded control ring 493 of control knob 490, with the internally threaded section 494 of the valve body 412. In the position shown in FIG. 13, the control knob 490 has been threadably mounted, within valve bore 418, to its most upstream point, at which point inclined radially offset inlet port means 496 are fully open to an annular clearance or space 498 provided between the valve bore 418 and the rotor chamber 450. Thus, as fluid enters the first fluid inlet means 416, a small portion thereof will move into and through annular space 498, thence through inclined radially offset inlet ports 496 and be directed onto fins or paddle members 482, and from there passing through the annular space 483 surrounding the downstream end of the rotor body 480 into an intermediate portion of 487 of the control knob 490. The flow of the water from fluid inlet 416 to intermediate portion 487 is denoted by arrows $W_1$. The rotor body 480, being mounted for rotation, in a relatively friction-free or free-running mode by means of its ball-bearing mounting 485, immediately commences to rotate whereby the main portion of the fluid W passing through the rotor bore 481 and into offset portion **481*a* will travel, in a generally annular, cone-shaped pattern, downstream along the flared outlet end portion 500 of control knob 490, to be directed, in that fashion, onto the user whether it be in a whirlpool bath or in a shower, or other uses. Of course, if the environment is a whirlpool bath, air entering the fluid stream, via lateral ports 502, 504 of valve body 412 and control knob 490, respectively, may be admixed with the water as it travels along the flared section 500** of the control knob.

For any given level of water pressure, this invention provides a simple and reliable means for altering the rotation of the rotor body 480 from a speed of rotation of as high as 4000 rpm to an rpm level of as low as 100 rpm. This is readily accomplished by unscrewing the control knob 490 (i.e., turning it counter-clockwise as viewed in the FIG. 13 position). As this unthreading of the control knob 490 occurs, the inclined radially offset ports 496 are moved to the right in FIG. 13 and may be partially closed by the shroud control ring 493 (which remains threadably engaged to the valve bore 418 and stationary because it is a separate and discrete component from the control knob 490), the degree of closure depending upon the degree of unthreading of the control knob 490. If the radially offset ports 496 are further moved to the right in FIG. 13, the ports 496 will be completely closed off by the shroud control ring 493; no fluid pressure will be exerted on the rotor body 480 and no rotational movement will result.

The following points are to be especially noted with respect to the FIGS. 12–17 embodiment. First, it is to be noted that the ball-bearing means 485 is encased within an annular cavity or groove 489 of the rotor body 480 and the ball-bearings are located upstream of the paddles 482, to which water stream $W_1$ is directed for rotational movement of the paddles. Because the ball-bearings 485 are located upstream of the rotational stream $W_1$ to the rotor paddles 482 and are protected by the upstream wall 499 of the rotor body, from the main mass of fluid flow W, the total fluid flow essentially completely bypasses the bearing means 485. Therefore, any particles, dirt, hair and the like in the fluid will bypass the ball-bearings, not deleteriously affect the performance of the bearings, and will result in a more controllable, predictable, rotation. By contrast, in the FIGS. 1–4 embodiment, the bearing surfaces of the rotor body 80 are located downstream of the rotationally directing fluid stream and there is sometimes a tendency for the rotor body to not be as free-running due to the location of the rotor body with respect to the impacting rotationally directing stream. Furthermore, the impurities in the fluid stream may become enmeshed by the rotor body 80, and bearings thereof of the FIGS. 1–4 embodiment.

In the FIGS. 12–17 embodiment, a maximum flow of water is made available for entry into rotor bore inlet 481*a* because no centrally located valve seat 112 is necessary as in the FIGS. 1–4 embodiment. Where a valve seat is present, an obstruction to the main fluid flow and a vortex is produced within the rotor bore. Both of these conditions are undesirable in effecting maximum fluid flow through rotor bore 481. In the FIGS. 12–17 embodiment, the minimum necessary diversion of directing stream $W_1$ may be calculated (and annular spacing 498 and dimensions of offset ports 496 calculated) with the remaining fluid stream W flowing through rotor bore 481 to the maximum possible extent—in an unimpeded manner.

The FIGS. 12–17 embodiment can be modified to have a rotor bore radially offset from its longitudinal axis, as shown in FIG. 7, or may be otherwise placed in the rotor body in order to alter the effluent path of fluid.

It is to be further noted that the fluid valve of the invention may be utilized solely as an air or gas valve, solely as a water or liquid valve, or as a gas-liquid (e.g. air-water admixture) valve.

The presently preferred embodiment of this invention is shown in FIGS. 18–21.

The FIGS. 18–21 embodiment is presently preferred for a number of reasons. In addition to the advantages heretofore enumerated with respect to the next previous embodiment, this embodiment provides the following advantages: (1) a more completely sealed ball-bearing mounting for rotor body 680 so as to minimize solid contaminants in the water stream which might otherwise foul the ball bearings 685 and the rotational movement of the rotor body (680); (2) the advantage of almost 100% flow of the water stream through the rotor bore of the rotor body, such maximum flow minimizing problems of contamination due to fluctuations in flow; (3) the effluent air-water stream can be readily made to follow various rotational effluent paths—specifically, not only that of one direction (e.g., clockwise), but that of a reverse direction (i.e. counterclockwise); and further, the rotational stream can be readily by-passed altogether if not desired.

The construction of the FIGS. 18–21 embodiment will now be set forth with special attention to the differences over the earlier embodiments herein described.

In FIGS. 18–21, the fluid nozzle or valve is designated generally by the numeral 600 and preferably comprises, generally, an elongated valve body 612, an external control knob 690, provided at its upstream end with a rotor chamber 650 and a control ring 693, all coaxially mounted within the valve body 612, the rotor chamber 650 partly enclosing a rotor body 680, the control means or ring 693 mounted at the upstream end of the rotor chamber 650 cooperating with the control knob means 690 to vary the effluent pattern of the rotary fluid stream, as will be described.

Figures 18, 19, 20, 21:
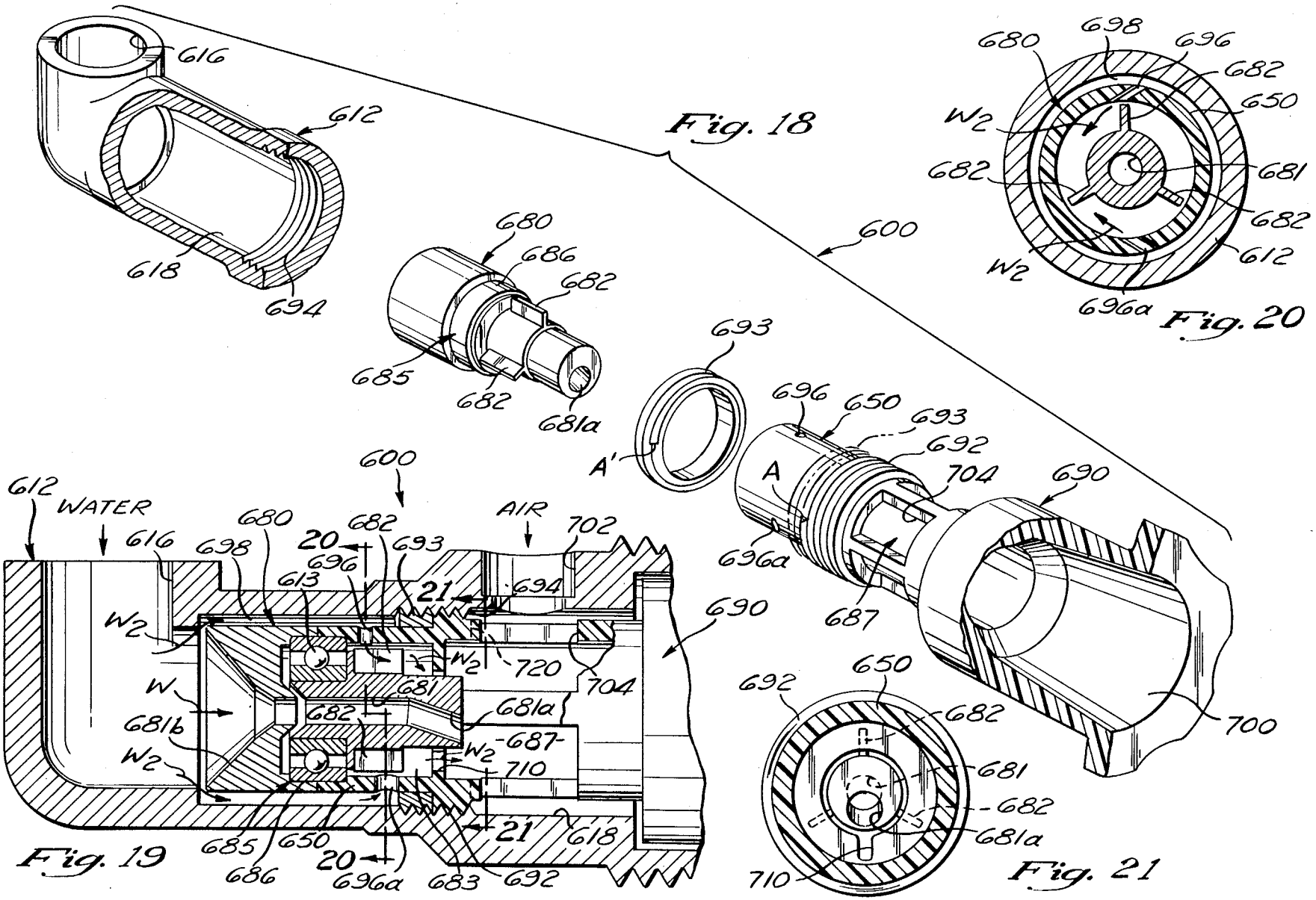
FIG. 18 is an exploded, perspective, partially sectional view of a sixth, and presently preferred, embodiment of my invention.
FIG. 19 is a fragmentary, longitudinal cross-section of the unit shown in FIG. 18 after the assembly thereof.
FIG. 20 is a transverse cross-section taken along line 20—20 of FIG. 19.
FIG. 21 is a transverse cross-section taken along line 21—21 of FIG. 20.

Referring to FIG. 19, the rotor body 680 is provided with a rotor bore 681, a downstream portion of which, 681*a*, is radially offset; the rotor body 680 is also provided with a plurality of external, generally radially projecting fins or paddle members 682 at its downstream end. Near the upstream end of the rotor body 680, a plurality of ball-bearings 613, contained within races in a conventional manner and designated generally by the numeral 685, are provided. The inlet to the rotor bore 681 (designated 681*b*), is enlarged with respect to the bore 681 and communicates directly with the main fluid stream W entering the first fluid inlet means 616 of valve body 612.

The rotor chamber 650 is shown as being integrally affixed (e.g., molded or casted) to a control means or knob 690 as best shown in FIGS. 18 and 19. It will be understood however that the rotor chamber may be a completely separate component from that of the control means or knob 690 and may be threadably engaged or otherwise connected thereto through various forms of mechanical linkage. The control means 690 has an externally threaded intermediate section 692 provided therein for threadable engagement thereof within the valve bore 618. Moreover, as best shown in FIGS. 18 and 19 a separate, externally threaded shroud control ring 693 slideably interfits onto the upstream end of control knob 690, immediately adjacent threaded section 692, the split threads A and A′ of sections 692 and 693 abutting each other as best shown in FIG. 18. The purpose of shroud control ring 693 will be explained hereafter.

To assemble the fluid valve components of this embodiment, the rotor body 680 is press-fitted onto the rotor chamber end of the control knob 690, as shown in FIG. 19, the press-fit occurring between a portion of the external surface 686 of the ball-bearing means 685 and the upstream end of the internal wall of the rotor chamber 680. The control knob 690 and rotor body 680, assembled thereto, is then threadably mounted within the valve bore 618 of the valve body 612 by means of the engagement of external threaded sections 692 and externally threaded control ring 693 of control knob 690, with the internally threaded section 694 of the valve body 612.

In the position shown in FIG. 19, the control knob 690 has been threadably mounted, within valve bore 618, to its most upstream point, and the control means or ring 693 abuts the adjacent threaded section 692 with the split threads A and $A^1$ of sections 692, 693 abutting each other as shown in FIG. 18. In this position, inclined radially offset inlet port means 696 are fully open to an annular clearance or space 698 provided between the valve bore 618 and the rotor chamber 650. Also, in the position shown in FIG. 19, a second substantially larger inlet port 696*a*, e.g., of approximately twice the volume of inlet port 696, and which is slightly downstream of inlet port 696, and inclined in the opposite direction to port 696, as shown in FIG. 20, is also completely open so that approximately twice as much water enters larger port 696*a* than does port 696.

Thus, as fluid enters the first fluid inlet means 616, a small portion thereof (e.g., 5% of total fluid flow, $W_2$) will move into and through annular space 698, thence through the oppositely inclined radially offset inlet ports 696, 696*a* and be directed onto the fins or paddle members 682. The greater fluid flow through port 696*a* will cause clockwise rotation of the paddle members 682. The water stream $W_2$ then passes through the annular space 683 surrounding the downstream end of the rotor body 680 into an intermediate portion 687 (containing air ports 704) of the control knob 690.

The rotor body 680, being mounted for rotation, in a relatively friction-free or free-running mode by means of its ball-bearing mounting 685, will immediately commence to rotate, under the influence of side-entering water stream $W_2$, whereby the main portion of the fluid W (e.g., 95% of the total) passing through the rotor bore 681 and into offset portion 681*a* will travel, in a generally annular, cone-shaped pattern, downstream along the flared outlet end portion 700 of control knob 690, to be directed, in that fashion, onto the user whether it be in a whirlpool bath, in a shower, or in other environments or uses.

It will be noted that the larger inlet port 696*a* is inclined so that the resultant stream $W_2$ will force paddle wheels 682 of rotor body 680 clockwise. By unthreading control knob 690 (turning knob 690 counterclockwise), side inlet port 696*a* is partially blocked off by stationary shroud control ring 693 and side inlet port 696 remains open whereby fluid stream $W_2$ enter both ports 696, 696*a* in opposite directions but can be readily balanced against each other to stall the rotation of rotor body 680. As further unthreading of the control knob 690 takes place, inlet port 696*a* is more fully blocked, and stream $W_2$ entering side inlet port 696 will be greater than the force of stream $W_2$ entering port 696*a*, and cause a flow reversal from clockwise to a counterclockwise rotation. The user can sense the directional change in water flow, and such a change is deemed desirable.

If the environment is a whirlpool path, air entering the fluid stream, via lateral ports 702, 704 of valve body 612 and control knob 690, respectively, may be admixed with the water as it travels along the flared section 700 of the control knob.

The following points are to be noted with respect to the FIGS. 18–21 embodiment. Firstly, there is no central plug in valve inlet means 616 and the clearance 698 between valve body 612 and the upstream end of rotor chamber 680 is such that approximately 5% of the total flow of water into the valve 600 moves along clearance 698 and the remaining approximately 95% moves through rotor bores 681, 681*a* to achieve a maximum effluent rotary stream.

Secondly, the ball-bearing means 685 are upstream of the inlet port 693 and are essentially completely concealed from the stream $W_1$. The direction of the main stream is also removed from the ball bearings 685, so that contaminants in the water streams W and $W_2$ will not foul the ball-bearings. The operability and reliability of the fluid valve 600 is thereby maximized.

Thirdly, because the side inlet ports 696 and 696*a* are not axially aligned, they can be selectively counterbalanced against each other. In this way, clockwise or counterclockwise effluent streams can be achieved, or even a complete by-pass of a rotational effluent stream, if desired.

Fourthly, it will be noted that in the position shown in FIG. 19, the side inlet port 696*a* is removed from the exit port 710 almost 360°. Because of this approximately 360° separation between inlet and outlet, the entering water stream $W_2$ through inlet 696*a* exerts maximum efficiency in turning paddles 682 of rotor body 680. An approximate 180° separation between inlet and outlet exists when side port 696 is the only open port.

It is to be further noted that external operation of the shroud control ring is not necessary. Thus, for example, if only the rotor chamber 650 and threaded ssections 692 and shroud ring 693 portion comprised the control means, the relative movement of the rotor chamber 650, (and its ports 696, 696*a*) with respect to stationary shroud control ring 693 could be made by inserting a screwdriver type element into valve body 612 to engage complementary slots 720 (formed adjacent the threads 692 and shown in phantom in FIG. 19).

It should also be noted that the shroud control ring 693 need not be a separate ring means from that of the valve body 612 but could quite readily be machined into, and as an integral part of, valve body 612. Such an integral shroud control ring will, preferably, have a split ring $A^1$, in order to rotationally align and position the rotor chamber 650 by the abutment of split thread A with split thread $A^1$ as described heretofore.

It should also be noted that it is the relative displacement of the shroud ring 693 and rotor chamber 650 that is important in achieving precise control; this means that the shroud ring 693 could be made moveable along the axis of the valve bore 618 and the rotor chamber be held stationary in the valve bore.

As with the FIGS. 12–17 embodiment, for any practical level of water pressure, this embodiment provides a simple and reliable means for altering the rotation of the rotor body 680 from a speed of rotation of as high as 4000 rpm to an rpm level of as low as 100 rpm.

In summary, the applicant has achieved the following:

(a) a simple and reliable means for continuously changing the effluent pattern of a water stream or a water-air stream, e.g., the effluent stream describing the path of an annular or cone-shaped discharge, the effluent pattern being determined by the nature of the rotor bore provided in the rotor body; and, in combination with (a)

(b) a simple and reliable means for varying the rate of revolution of the rotor body at any particular level of water pressure.

It will appreciated by those skilled in the art that many changes, modifications and substitutions are possible without departing from the spirit and scope of the invention. Therefore, applicant intends to be bound only by the scope of the appended claims.

I claim:

1. A fluid valve for discharging a directional outlet fluid stream of continuously changing direction comprising:

a valve body having a first fluid inlet means and having a valve bore therethrough, said valve bore having a longitudinal axis and a fluid outlet means;

an elongated rotor body mounted within said valve bore and having a rotor bore passing therethrough, said rotor body being mounted for movement within said valve bore to enable displacement of said rotor bore with respect to said longitudinal axis of said valve bore, said rotor bore having a rotor bore inlet and rotor bore outlet, said rotor bore inlet beng in fluid communication with said first fluid inlet means and said rotor bore outlet having its outer end communicating with said fluid means of said valve body; and a rotor chamber having fluid inlet port means in communication with said first fluid inlet means, said fluid inlet port means of said rotor chamber being radially offset with respect to said longitudinal axis of said valve bore, and said radially offset fluid inlet port means of said rotor chamber being in communication with said rotor body whereby at least a portion of fluid entering said first fluid inlet means initially passes into said radially offset fluid inlet port means of said rotor chamber and thence exerts external force on said rotor body to cause movement of said rotor body and displacement of said rotor bore with respect to said longitudinal axis of said valve bore, and whereby fluid also passes through said rotor bore inlet into said rotor bore, and into said fluid outlet means of said valve body, as a directional outlet stream of predetermined continuously changing direction, as determined by the displacement of said rotor bore; and positioning means for adjustably positioning said rotor chamber along the direction of the longitudinal axis of said valve bore whereby to adjust the rate of movement of said rotor body by increasing or decreasing the amount of fluid entering said first fluid inlet means and conversely decreasing or inceasing the amount of fluid entering said radially offset fluid inlet port means of said rotor chamber.

2. The fluid valve of claim 1 wherein said rotor body is mounted for continuous up-down movement under the influence of external fluid force on said rotor body.

3. The fluid valve of claim 2 wherein said rotor bore is concentric with said rotor body, and said directional outlet stream describes a generally conical surface of revolution.

4. The fluid valve of claim 1 wherein said rotor body is mounted for both rocking and rotational movement under the influence of external fluid force on said rotor body.

5. The fluid valve of claim 4 wherein said rotor bore is concentric with said rotor body, and said directional outlet stream describes a generally conical surface of revolution.

6. The fluid valve of claims 1 wherein said rotor body is mounted for essential rotary movement under the influence of external fluid force on said rotor body.

7. The fluid valve of claim 1 wherein said rotor body is mounted for essentially rotary movement under the influence of external fluid force on said rotor body and said rotor bore is parallel to, but radially offset from, said longitudinal axis of said valve bore.

8. The fluid valve of claim 1 wherein said positioning means for adjustably positioning said rotor chamber comprises an external control knob, a control knob body extending inwardly within said valve bore, and a connector end, affixed to the inner end of said knob body, for connection to said rotor chamber and movment thereof along the longitudinal axis of said valve bore.

9. The fluid valve of claim 8 wherein said control knob body is of generally frustro-conical shape.

10. The fluid valve of claim 8 wherein said connector end threadably engages said rotor chamber for movement thereof along the said longitudinal axis of said valve bore.

11. The fluid valve of claim 8 wherein said rotor chamber is integrally connected to said inner end of said knob body.

12. The fluid valve of claim 11 wherein said rotor chamber threadably engages said valve body for movement of said rotor chamber along the longitudinal axis of said valve bore of said valve body.

13. The fluid valve of claim 1 wherein said rotor chamber is integrally connected to an elongated control member, said control member extending through the said valve bore to the exterior of the outlet side of said valve bore.

14. The fluid valve of claim 1 wherein said rotor body is mounted for essentially rotary movement under the influence of external fluid force on said rotor body and said motor bore is a least partially eccentric with respect to said longitudinal axis of said valve bore.

15. The valve of claim 1 wherein said radially offset fluid inlet port means of said rotor chamber is inclined for injection of fluid tangentially onto said rotor body thereby creating a tangential force within said rotor chamber for moving said rotor body.

16. The fluid valve of claim 15 wherein said rotor body is provided with a toroidal surface for mounting in a seat formed in said rotor chamber, said toroidal mounting providing a fulcrum for both rocking and rotational movement of said rotor body under the influence of said angularly injected fluid.

17. The fluid valve of claim 15 wherein said rotor body is tubular and is provided with an off-center fulcrum axis whereby to provide both rocking and rotational movement of said rotor body under the influence of said angularly injected fluid.

18. The fluid valve of claim 1 wherein said rotor body has externally mounted thereto a plurality of generally radially extending fins and wherein said fluid entering said radially offset fluid inlet means of said rotor chamber engages said fins to thereby exert external force on said rotor body and to cause movement thereof.

19. The fluid valve of claim 1 wherein means is provided for longitudinally displacing said radially offset fluid inlet port means of said rotor chamber from a first position to a second position to thereby alter the amount of fluid flow entering said radially offset fluid inlet port means.

20. The fluid valve of claim 19 wherein said means for longitudinally displacing said radially offset fluid inlet port means of said rotor chamber comprises means for displacing said rotor chamber containing said radially offset fluid inlet port means, from a first position in said valve bore, wherein said radially offset port means is fully open, to a multiplicity of intermediate positions wherein said radially offset port means is only partially open, and to a third position wherein said radially offset port means is closed.

21. The fluid valve of claim 19 wherein said radially offset fluid inlet port means are in transverse alignment.

22. The fluid valve of claim 19 wherein at least a first one of said radially offset fluid inlet port means is provided upstream with respect to a second of said radially offset fluid inlet port means, and said first inlet port means is inclined in one direction and said second inlet port means is inclined in a different direction whereby fluid entering said first and second port means act counter to each other.

23. The fluid valve of claim 22 wherein said first one of said radially offset fluid inlet port means is substantially larger than a second of said radially offset fluid inlet port means.

24. The fluid valve of claim 19 wherein said means for longitudinally displacing said radially offset fluid inlet port means of said rotor chamber comprises means for displacing said rotor chamber containing said radially offset fluid inlet port means, from a first position in said valve bore, wherein said radially offset port means is fully open, to a multiplicity of intermediate positions wherein said radially offset port means is only partially open.

25. The fluid valve of claim 1 wherein said rotor body is mounted, for essentially rotary movement under the influence of external fluid force on said rotor body, proximate to the downstream end of said rotor body.

26. The fluid valve of claim 1 wherein said rotor body is mounted, for essentially rotary movement under the influence of external fluid force on said rotor body, proximate to the upstream end of said rotor body.

27. The fluid valve of claim 1 wherein said rotor body is mounted onto said rotary chamber by ball-bearing means, for essentially rotary movement under the influence of external fluid force on said rotor body.

28. The fluid valve of claim 27 wherein said ball-bearing means are encased, on its upstream side, by a wall of said rotor body whereby said ball-bearing means are shielded from fluid flow passing through said rotor bore inlet.

29. The fluid valve of claim 1 wherein said positioning means for adjustably positioning said rotor chamber is located internally of said valve body.

30. The fluid valve of claim 1 wherein said positioning means for adjustably positioning said rotor chamber is a slot means located internally of said valve body.

31. The fluid valve of claim 1 wherein said rotor body is provided with fin members whereby said fluid passing into said radially offset fluid inlet port means exerts force on said fin members to cause movement of said rotor body.

32. The fluid valve of claim 1 wherein said rotor body is provided with fin members whereby said fluid passing into said radially offset fluid inlet port means exerts force on said fin members to cause rotary movement of said rotor body.

33. The fluid valve of claim 1 wherein said rotor body is mounted, for essentially rotary movement under the influence of external fluid force on said rotor body, proximate to the downstream end of said rotor body.

34. The fluid valve of claim 1 wherein said rotor body is mounted, for essentially rotary movement under the influence of external fluid force on said rotor body, proximate to the upstream end of said rotor body.

35. The fluid valve of claim 1 wherein said rotor body is mounted onto said rotary body by ball-bearing means, for essentially rotary movement under the influence of external fluid force on said rotor body.

36. The combination of a valve body for a fluid nozzle with a control means for adjusting the effluent fluid flow pattern which comprises:

a valve body for a fluid valve having a first fluid inlet means, said valve body defining a valve bore immediately downstream of said first fluid inlet means, a rotor chamber mounted for axial movement within said valve bore and defining radially offset fluid inlet aperture means for fluid communication with said first fluid inlet means, a rotor body defining a rotor bore mounted for rotary movement, within said valve bore, said rotor body being in fluid communication with said radially offset fluid inlet aperture means, and said rotor bore being in fluid communication with said first fluid inlet means, said control means including a shroud ring provided in said valve bore, and positioned to overly and block at least a portion of said radially offset fluid inlet aperture means in any of a series of positions of said axially moveable rotor chamber, and further positioned to permit unrestricted flow to said radially offset fluid inlet aperture means in a second position of said axially moveable rotor chamber, whereby fluid passes from said first fluid inlet means to both said rotor bore and to said radially offset fluid inlet aperture means in varying ratios depending upon the axial positioning of said rotor chamber, said varying ratios determining the extent of the directional forces impinging on said rotor body to thereby adjust the pattern of effluent fluid flow through said rotor bore, and a fluid outlet means in fluid communication with said rotor bore.

37. The combination of claim 36 wherein air inlet ports are provided to said valve bore between said first fluid inlet means and said fluid outlet means.

38. The combination of claim 36 wherein said valve bore is provided with an internally threaded surface portion, and said rotor chamber is threadably engaged with said internally threaded surface portion of axial movement relative to said shroud ring.

39. The combination of claim 36 wherein said rotor chamber is axially moveable by said control means having a handle portion thereof, located externally of said valve body.

40. The combination of claim 36 wherein said rotor chamber is axially moveable by said control means having an adjustment means located internally of said valve body.

41. The combination of claim 36 wherein said rotor body is provided with fin members whereby said fluid passing into said radially offset fluid inlet aperture means exerts force on said fin members to cause rotary movement of said rotor body.

42. The combination of claim 36 wherein said shroud ring is a separate member from that of said valve body.

43. The combination of claim 36 wherein said shroud ring is integral with said valve body.

44. The combination of claim 36 wherein said radially offset fluid inlet pressure means comprises a plurality of port means in transverse alignment with each other.

45. The combination of claim 36 wherein said radially offset fluid inlet aperture means comprises a plurality of port means transversely offset with respect to each other.

46. The combination of claim 38 wherein said radially offset fluid inlet aperture means comprises a plurality of port means transversely offset with respect to each other and said port means are inclined in opposed directions.

47. The combination of claim 38 wherein said radially offset fluid inlet aperture means comprises a plurality of port means transversely offset with respect to each other, one of said port means is substantially larger than the other port means and said one of said port means is inclined in an opposed direction to that of said other port means.

48. The combination of claim 38 wherein said shroud ring is annular and terminates in a split thread.

49. The combination of claim 36 wherein said shroud ring is annular and terminates in a split thread, and said rotor chamber has at least a portion thereof externally threaded and threadably engageable with an internally threaded surface portion of said valve bore, said externally threaded portion of said rotor chamber terminating at its upstream end in a split thread whereby abutment of said split thread of said rotor chamber with the split thread of said shroud ring precisely positions said rotor chamber and said radially offset fluid inlet aperture means with respect to said shroud ring.

50. A fluid valve for discharging a directional outlet fluid stream of continuously changing direction comprising:

a valve body having a first fluid inlet means and having a valve bore therethrough, said valve bore having a longitudinal axis and a fluid outlet means;

an elongated rotor body mounted within said valve bore and having a rotor bore passing therethrough, said rotor body being mounted for movement within said valve bore to enable displacement of said rotor bore with respect to said longitudinal axis of said valve bore, said rotor bore having a rotor bore inlet and rotor bore outlet, said rotor bore inlet beng in fluid communication with said first fluid inlet means and said rotor bore outlet having its outer end communicating with said fluid means of said valve body; and a rotor chamber having fluid inlet port means in communication with said first fluid inlet means, said fluid inlet port means of said rotor chamber being radially offset with respect to said longitudinal axis of said valve bore, and said radially offset fluid inlet port means of said rotor chamber being in communication with said rotor body whereby at least a portion of fluid entering said first fluid inlet means initially passes into said radially offset fluid inlet port means of said rotor chamber and thence exerts external force on said rotor body to cause movement of said rotor body and displacement of said rotor bore with respect to said longitudinal axis of said valve bore, and whereby fluid also passes through said rotor bore inlet into said rotor bore, and into said fluid outlet means of said valve body, as a directional outlet stream of predetermined continuously changing direction, as determined by the displacement of said rotor bore; and said rotor chamber being provided with a control means to adjust the rate of movement of said rotor body by increasing or decreasing the amount of fluid entering said first fluid inlet means and conversely decreasing or increasing the amount of fluid entering said radially offset fluid inlet port means of said rotor chamber.

* * * * *